US006012194A

United States Patent [19]

Eshbach et al.

[11] Patent Number: 6,012,194

[45] Date of Patent: Jan. 11, 2000

[54] PAINT BRUSH HANDLE

[76] Inventors: Douglas Eshbach; Elizabeth Eshbach, both of 3292 State Hill Rd., Sinking Spring, Pa. 19608

[21] Appl. No.: 09/150,589

[22] Filed: Sep. 10, 1998

[51] Int. Cl.[7] ..... A46B 5/02

[52] U.S. Cl. ..... 15/143.1; 16/421; 16/441

[58] Field of Search ..... 16/421, 441; 15/143.1, 15/191.1, 192, 193, 204, 205

[56] References Cited

FOREIGN PATENT DOCUMENTS 1257700 2/1961 France ..... 15/192

*Primary Examiner*—Randall E. Chin

[57] ABSTRACT

A paint brush handle for comfortably fits in the hand of a user. The handle includes first and second faces, opposite first and second ends, first and second sides, and a longitudinal axis extending between the first and second ends. An insertion portion is located adjacent the first end. The insertion portion is designed for insertion into the ferrule. The insertion portion has a generally rectangular cross section taken transverse the longitudinal axis, and a thickness defined between the first and second faces. The first and second faces have generally flat regions along the insertion portion. A butt portion is located adjacent the second end. The butt portion is designed for positioning in the palm of a user. The butt portion has a generally circular cross section transverse the longitudinal axis. The butt portion has a maximum thickness defined between the first and second faces. A middle portion is interposed between the insertion portion and the butt portion. The middle portion is designed for positioning the fingers and thumb of the user. The middle portion has a generally rectangular cross section taken transverse the longitudinal axis, and a thickness defined between the first and second faces. The first and second faces have generally flat regions along the middle portion. The generally flat regions of the first and second faces along the middle portion lie in generally parallel planes. The middle portion has a thickness defined between the first and second faces. The thickness of the middle portion is greater than the thickness of the insertion portion and less than the maximum thickness of the butt portion.

13 Claims, 3 Drawing Sheets

PAINT BRUSH HANDLE

BACKGROUND OF THE INVENTION

1. Field of the Invention

The present invention relates to paint brush handles and more particularly pertains to a new paint brush handle for comfortably fits in the hand of a user.

2. Description of the Prior Art

The use of paint brush handles is known in the prior art. More specifically, paint brush handles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. Des. 251,160; U.S. Pat. No. Des. 250,677; U.S. Pat. No. 4,020,520; U.S. Pat. No. 3,204,278; U.S. Pat. No. 5,75,975; and U.S. Pat. No. 4,495,669.

While these devices fulfill their respective, particular objectives and requirements, the aforementioned patents do not disclose a new paint brush handle. The inventive device includes first and second faces, opposite first and second ends, first and second sides, and a longitudinal axis extending between the first and second ends. An insertion portion is located adjacent the first end. The insertion portion is designed for insertion into the ferrule. The insertion portion has a generally rectangular cross section taken transverse the longitudinal axis, and a thickness defined between the first and second faces. The first and second faces have generally flat regions along the insertion portion. A butt portion is located adjacent the second end. The butt portion is designed for positioning in the palm of a user. The butt portion has a generally circular cross section transverse the longitudinal axis. The butt portion has a maximum thickness defined between the first and second faces. A middle portion is interposed between the insertion portion and the butt portion. The middle portion is designed for positioning the fingers and thumb of the user. The middle portion has a generally rectangular cross section taken transverse the longitudinal axis, and a thickness defined between the first and second faces. The first and second faces have generally flat regions along the middle portion. The generally flat regions of the first and second faces along the middle portion lie in generally parallel planes. The middle portion has a thickness defined between the first and second faces. The thickness of the middle portion is greater than the thickness of the insertion portion and less than the maximum thickness of the butt portion.

In these respects, the paint brush handle according to the present invention substantially departs from the conventional concepts and designs of the prior art, and in so doing provides an apparatus primarily developed for the purpose of comfortably fits in the hand of a user.

SUMMARY OF THE INVENTION

In view of the foregoing disadvantages inherent in the known types of paint brush handles now present in the prior art, the present invention provides a new paint brush handle construction wherein the same can be utilized for comfortably fits in the hand of a user.

The general purpose of the present invention, which will be described subsequently in greater detail, is to provide a new paint brush handle apparatus and method which has many of the advantages of the paint brush handles mentioned heretofore and many novel features that result in a new paint brush handle which is not anticipated, rendered obvious, suggested, or even implied by any of the prior art paint brush handles, either alone or in any combination thereof.

To attain this, the present invention generally comprises first and second faces, opposite first and second ends, first and second sides, and a longitudinal axis extending between the first and second ends. An insertion portion is located adjacent the first end. The insertion portion is designed for insertion into the ferrule. The insertion portion has a generally rectangular cross section taken transverse the longitudinal axis, and a thickness defined between the first and second faces. The first and second faces have generally flat regions along the insertion portion. A butt portion is located adjacent the second end. The butt portion is designed for positioning in the palm of a user. The butt portion has a generally circular cross section transverse the longitudinal axis. The butt portion has a maximum thickness defined between the first and second faces. A middle portion is interposed between the insertion portion and the butt portion. The middle portion is designed for positioning the fingers and thumb of the user. The middle portion has a generally rectangular cross section taken transverse the longitudinal axis, and a thickness defined between the first and second faces. The first and second faces have generally flat regions along the middle portion. The generally flat regions of the first and second faces along the middle portion lie in generally parallel planes. The middle portion has a thickness defined between the first and second faces. The thickness of the middle portion is greater than the thickness of the insertion portion and less than the maximum thickness of the butt portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new paint brush handle apparatus and method which has many of the advantages of the paint brush handles mentioned heretofore and many novel features that result in a new paint brush handle which is not anticipated, rendered obvious, suggested, or even implied by any of the prior art paint brush handles, either alone or in any combination thereof.

It is another object of the present invention to provide a new paint brush handle which may be easily and efficiently manufactured and marketed.

It is a further object of the present invention to provide a new paint brush handle which is of a durable and reliable construction.

An even further object of the present invention is to provide a new paint brush handle which is susceptible of a low cost of manufacture with regard to both materials and labor, and which accordingly is then susceptible of low prices of sale to the consuming public, thereby making such paint brush handle economically available to the buying public.

Still yet another object of the present invention is to provide a new paint brush handle which provides in the apparatuses and methods of the prior art some of the advantages thereof, while simultaneously overcoming some of the disadvantages normally associated therewith.

Still another object of the present invention is to provide a new paint brush handle for comfortably fits in the hand of a user.

Yet another object of the present invention is to provide a new paint brush handle which includes first and second faces, opposite first and second ends, first and second sides, and a longitudinal axis extending between the first and second ends. An insertion portion is located adjacent the first end. The insertion portion is designed for insertion into the ferrule. The insertion portion has a generally rectangular cross section taken transverse the longitudinal axis, and a thickness defined between the first and second faces. The first and second faces have generally flat regions along the insertion portion. A butt portion is located adjacent the second end. The butt portion is designed for positioning in the palm of a user. The butt portion has a generally circular cross section transverse the longitudinal axis. The butt portion has a maximum thickness defined between the first and second faces. A middle portion is interposed between the insertion portion and the butt portion. The middle portion is designed for positioning the fingers and thumb of the user. The middle portion has a generally rectangular cross section taken transverse the longitudinal axis, and a thickness defined between the first and second faces. The first and second faces have generally flat regions along the middle portion. The generally flat regions of the first and second faces along the middle portion lie in generally parallel planes. The middle portion has a thickness defined between the first and second faces. The thickness of the middle portion is greater than the thickness of the insertion portion and less than the maximum thickness of the butt portion.

Still yet another object of the present invention is to provide a new paint brush handle that provides better brush control when painting.

Even still another object of the present invention is to provide a new paint brush handle that helps prevent cramping and soreness in the hand of the user during prolonged use holding the handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
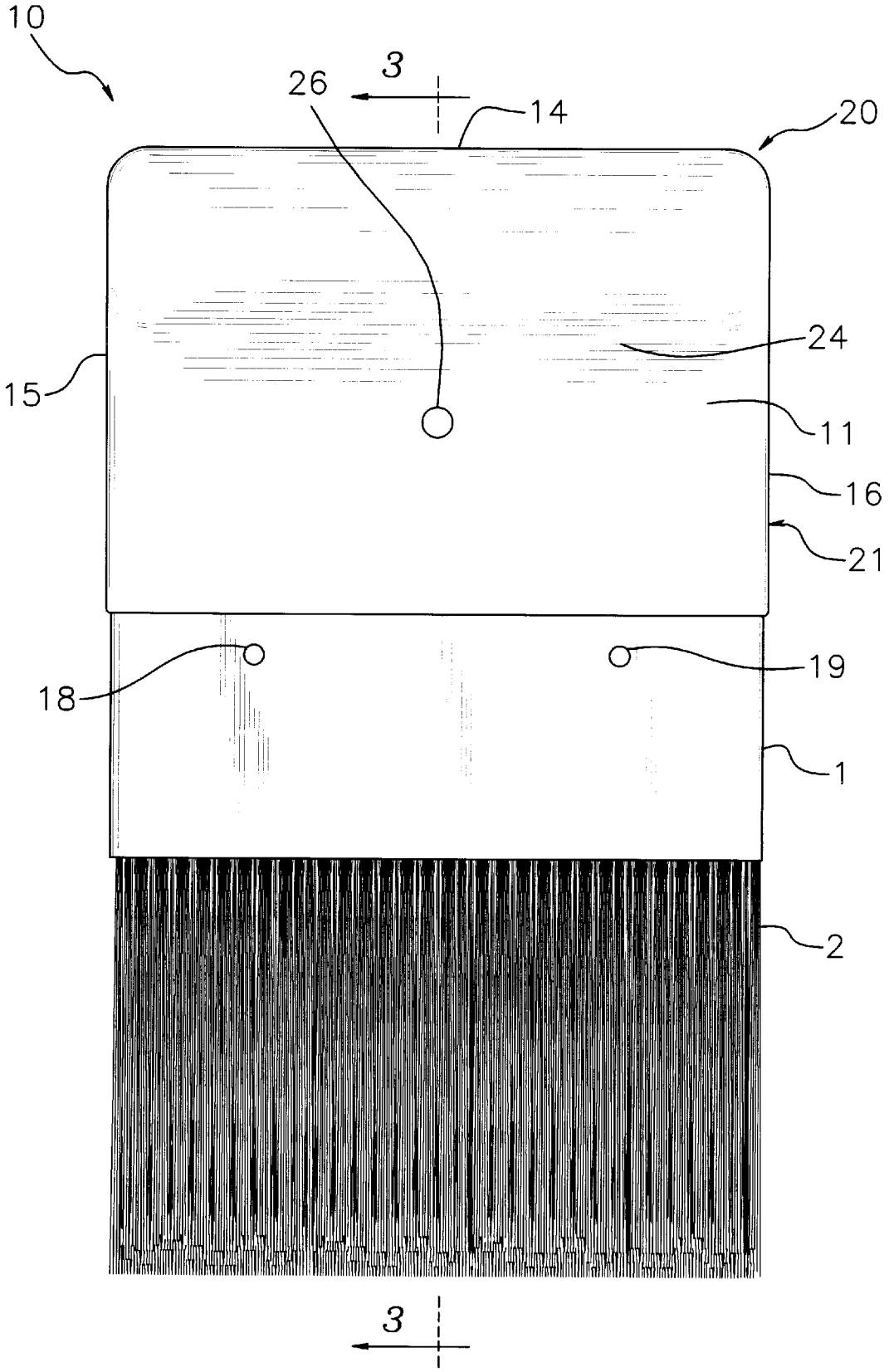
FIG. 1 is a schematic side view of the first face of a new paint brush handle according to the present invention.
Figure 2:
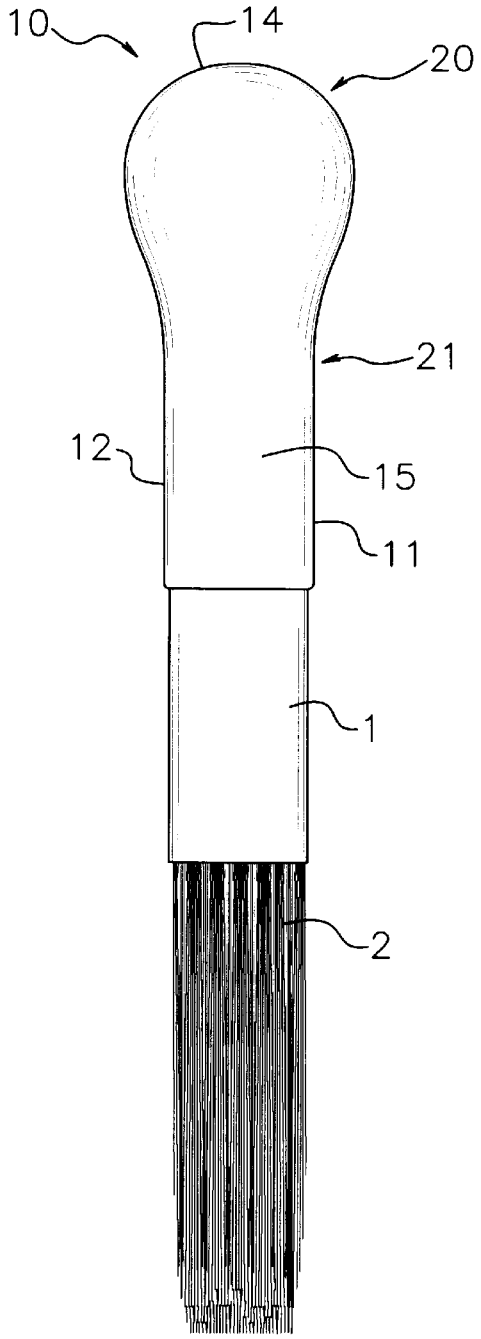
FIG. 2 is a schematic side view of the first side of the present invention.
Figure 3:
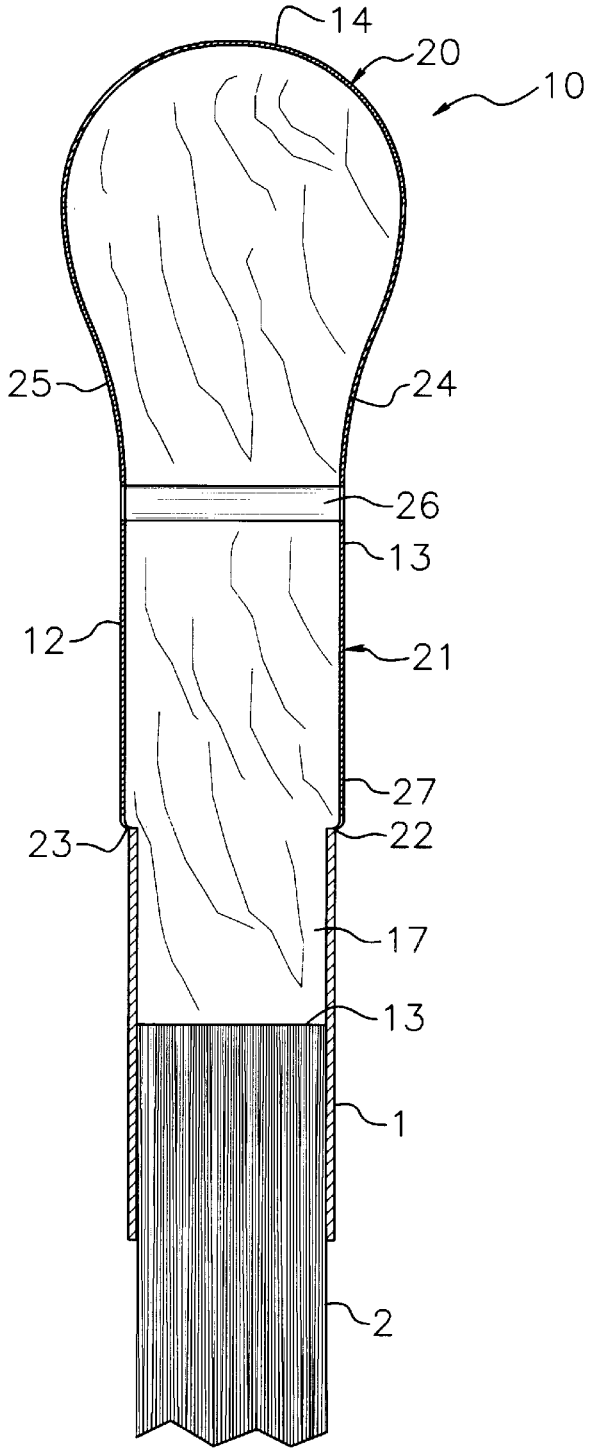
FIG. 3 is a schematic cross-sectional view of the present invention.
Figure 4:
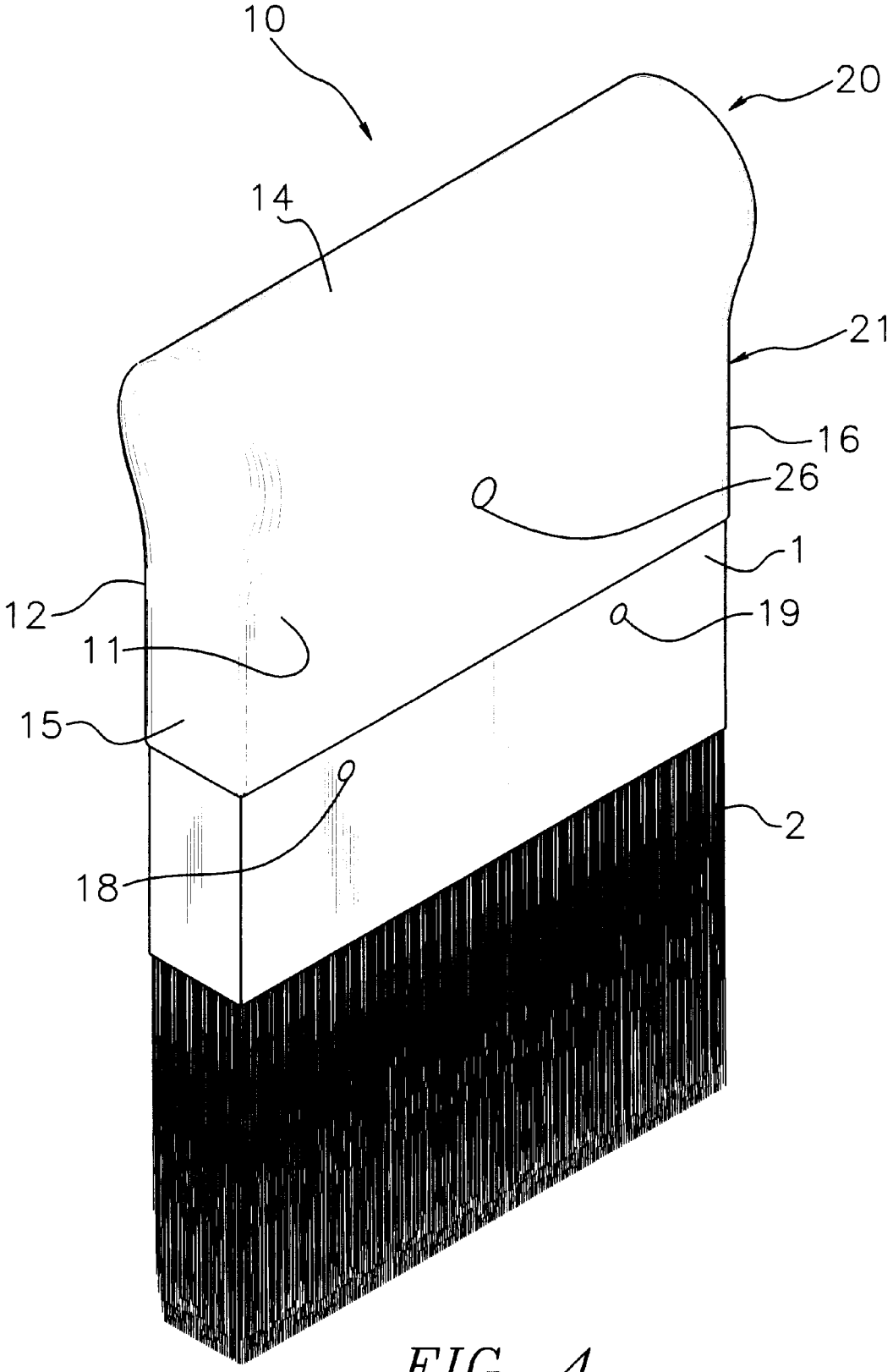
FIG. 4 is a schematic perspective view of the present invention.

With reference now to the drawings, and in particular to FIGS. 1 through 4 thereof, a new paint brush handle embodying the principles and concepts of the present invention and generally designated by the reference numeral 10 will be described.

As best illustrated in FIGS. 1 through 4, the paint brush handle 10 generally comprises first and second faces 11,12, opposite first and second ends 13,14, first and second, sides, and a longitudinal axis extending between the first and second ends 13,14. An insertion portion 17 is located adjacent the first end 13. The insertion portion 17 is designed for insertion into the ferrule 1. The insertion portion 17 has a generally rectangular cross section taken transverse the longitudinal axis, and a thickness defined between the first and second faces 11,12. The first and second faces 11,12 have generally flat regions along the insertion portion 17. A butt portion 20 is located adjacent the second end 14. The butt portion 20 is designed for positioning in the palm of a user. The butt portion 20 has a generally circular cross section transverse the longitudinal axis. The butt portion 20 has a maximum thickness defined between the first and second faces 11,12. A middle portion 21 is interposed between the insertion portion 17 and the butt portion 20. The middle portion 21 is designed for positioning the fingers and thumb of the user. The middle portion 21 has a generally rectangular cross section taken transverse the longitudinal axis, and a thickness defined between the first and second faces 11,12. The first and second faces 11,12 have generally flat regions along the middle portion 21. The generally flat regions of the first and second faces 11,12 along the middle portion 21 lie in generally parallel planes. The middle portion 21 has a thickness defined between the first and second faces 11,12. The thickness of the middle portion 21 is greater than the thickness of the insertion portion 17 and less than the maximum thickness of the butt portion 20.

In closer detail, the handle 10 is designed for use in combination with a ferrule 1 and bristles 2 or filling of a paint brush. The handle 10 has first and second faces 11,12, opposite first and second ends 13,14, first and second sides 15,16, and a longitudinal axis extending between the first and second ends 13,14. Preferably, the corners of the handle 10 are rounded to aid the comfort of a user. An insertion portion 17 is located adjacent the first end 13. In use, the insertion portion 17 is designed for insertion into the ferrule 1 and secured to the ferrule 1 by retaining pins 18,19 extend through the ferrule 1 and into the butt portion 20. The insertion portion 17 has a generally rectangular cross section taken transverse the longitudinal axis, and a thickness defined between the first and second faces 11,12. The first and second faces 11,12 have generally flat regions along the insertion portion 17 that preferably lie in generally parallel planes.

The bulbous butt portion 20 is located adjacent the second end 14. In use, the butt portion 20 is designed for positioning in the palm of a user. The butt portion 20 has a generally circular cross section transverse the longitudinal axis so that the butt portion 20 is generally cylindrical in shape. The butt portion 20 has a maximum thickness defined between the outermost portions of the first and second faces 11,12.

The middle portion 21 is interposed between the insertion portion 17 and the butt portion 20. In use, the middle portion 21 is designed for positioning the fingers and thumb of the user grasping the handle 10. The middle portion 21 has a generally rectangular cross section taken transverse the longitudinal axis, and a thickness defined between the first and second faces 11,12. The first and second faces 11,12 have generally flat regions along the middle portion 21 that preferably lie in generally parallel planes. Ideally, the planes of the generally flat regions of the first and second faces 11,12 along the middle portion 21 are generally parallel to the planes of the generally flat regions of the first and second faces 11,12 along the insertion portion 17. The middle portion 21 has a thickness defined between the first and second faces 11,12, the thickness of the middle portion 21 is greater than the thickness of the insertion portion 17 and less than the maximum thickness of the butt portion 20. Preferably, the maximum thickness of the butt portion 20 is at least about twice the thickness of the middle portion 21. In an ideal illustrative embodiment for a 2½-inch wide brush, the maximum thickness of the butt portion 20 is about 1 inch and the thickness of the middle portion 21 is about ½ inch.

The first and second faces 11,12 each have a shoulder 22,23 formed between the middle portion 21 and the insertion portion 17 designed for abutting against the ferrule 1 when the insertion portion is inserted into the ferrule. The first and second faces 11,12 along the middle portion 21 each preferably have an arcuate region 24,25 adjacent the butt portion 20 such that the first and second faces 11,12 curve between the middle portion 21 and butt portion 20.

The insertion, butt and middle portion 17,20,21 each has a length defined in a direction extending between the first and second ends 13,14. Preferably, the length of the middle portion 21 is about equal to the butt portion 20. In the ideal illustrative embodiment, the length of the middle portion 21 is about 1 inch and the length of the butt portion 20 is about 1 inch.

Preferably, the middle portion 21 has a bore 26 therethrough extending between the first and second faces 11,12. The bore 26 is preferably generally cylindrical and is designed for hanging the handle 10 on a hanging device such as hook of nail. The bore 26 is preferably positioned on the middle portion 21 towards the butt portion 20 with a center axis of the bore located at a midpoint between the first and second sides 15,16. In the ideal illustrative embodiment, the bore 26 ideally has a diameter of about ¼ inch.

An outer coating 27 may optionally be provided on the butt portion 20 and the middle portion 21. The outer coating 27 should preferably substantially covers the butt portion 20 and the middle portion 21 when provided. The outer coating 27 preferably comprises a resiliently compressible material for aiding the grip of the user while holding the handle 10 such as a resiliently compressible rubber.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A handle for use in combination with a ferrule and bristles of a paint brush, said handle comprising:

first and second faces, opposite first and second ends, first and second sides, a longitudinal axis extending between said first and second ends;

an insertion portion being located adjacent said first end, said insertion portion being adapted for insertion into the ferrule;

said insertion portion having a generally rectangular cross section taken transverse said longitudinal axis, and a thickness defined between said first and second faces, said first and second faces having generally flat regions along said insertion portion;

a butt portion being located adjacent said second end, said butt portion being adapted for positioning in the palm of a user, said butt portion having a generally circular cross section transverse said longitudinal axis, said butt portion having a maximum thickness defined between said first and second faces;

a middle portion interposed between said insertion portion and said butt portion, said middle portion being adapted for positioning the fingers and thumb of the user;

said middle portion having a generally rectangular cross section taken transverse said longitudinal axis, and a thickness defined between said first and second faces, said first and second faces having generally flat regions along said middle portion, said generally flat regions of said first and second faces along said middle portion lying in generally parallel planes;

said middle portion having a thickness defined between said first and second faces, said thickness of said middle portion being greater than said thickness of said insertion portion and less than said maximum thickness of said butt portion.

2. The handle of claim 1, wherein said planes of said generally flat regions of said first and second faces along said middle portion are generally parallel to said planes of said generally flat regions of said first and second faces along said insertion portion.

3. The handle of claim 1, wherein said maximum thickness of said butt portion is at least about twice said thickness of said middle portion.

4. The handle of claim 3, wherein said maximum thickness of said butt portion is about 1 inch and wherein said thickness of said middle portion is about ½ inch.

5. The handle of claim 1, wherein said first and second faces each have a shoulder formed between said middle portion and said insertion portion, said shoulders being adapted for abutting against the ferrule.

6. The handle of claim 1, wherein said first and second faces along said middle portion each have an arcuate region adjacent said butt portion such that said first and second faces curve between said middle portion and butt portion.

7. The handle of claim 1, wherein said insertion, butt and middle portions each have a length defined in a direction extending between said first and second ends, wherein said length of said middle portion is about equal to said butt portion.

8. The handle of claim 7, wherein said length of said middle portion is about 1 inch, wherein said length of said butt portion is about 1 inch.

9. The handle of claim 1, wherein said middle portion has a bore therethrough extending between said first and second faces.

10. The handle of claim 9, wherein said bore is positioned on said middle portion towards said butt portion, said bore having a center axis located at a midpoint between said first and second sides.

11. The handle of claim 1, further comprising an outer coating being provided on said butt portion and said middle portion.

12. A handle for use in combination with a ferrule and bristles of a paint brush, said handle comprising:

first and second faces, opposite first and second ends, first and second sides, a longitudinal axis extending between said first and second ends;

an insertion portion being located adjacent said first end, said insertion portion being adapted for insertion into the ferrule;

said insertion portion having a generally rectangular cross section taken transverse said longitudinal axis, and a thickness defined between said first and second faces, said first and second faces having generally flat regions along said insertion portion, said regions of said first and second faces along said insertion portion lying in generally parallel planes;

a butt portion being located adjacent said second end, said butt portion being adapted for positioning in the palm of a user, said butt portion having a generally circular cross section transverse said longitudinal axis, said butt portion having a maximum thickness defined between said first and second faces;

a middle portion interposed between said insertion portion and said butt portion, said middle portion being adapted for positioning the fingers and thumb of the user;

said middle portion having a generally rectangular cross section taken transverse said longitudinal axis, and a thickness defined between said first and second faces, said first and second faces having generally flat regions along said middle portion, said generally flat regions of said first and second faces along said middle portion lying in generally parallel planes;

said planes of said generally flat regions of said first and second faces along said middle portion being generally parallel to said planes of said generally flat regions of said first and second faces along said insertion portion;

said middle portion having a thickness defined between said first and second faces, said thickness of said middle portion being greater than said thickness of said insertion portion and less than said maximum thickness of said butt portion;

wherein said maximum thickness of said butt portion is at least about twice said thickness of said middle portion;

said first and second faces each having a shoulder formed between said middle portion and said insertion portion, said shoulders being adapted for abutting against the ferrule;

said first and second faces along said middle portion each having an arcuate region adjacent said butt portion such that said first and second faces curve between said middle portion and butt portion;

said insertion, butt and middle portions each having a length defined in a direction extending between said first and second ends;

wherein said length of said middle portion is about equal to said butt portion;

said middle portion having a bore therethrough extending between said first and second faces, said bore being generally cylindrical, said bore being positioned on said middle portion towards said butt portion, said bore having a center axis located at a midpoint between said first and second sides; and an outer coating being provided on said butt portion and said middle portion, said outer coating substantially covering said butt portion and said middle portion, said outer coating comprising a resiliently compressible material for aiding the grip of the user.

13. A paint brush, comprising:

a ferrule having bristles extending therefrom;

a handle having first and second faces, opposite first and second ends, first and second sides, a longitudinal axis extending between said first and second ends;

said handle having an insertion portion being located adjacent said first end, said insertion portion being inserted into the ferrule;

said insertion portion having a generally rectangular cross section taken transverse said longitudinal axis, and a thickness defined between said first and second faces, said first and second faces having generally flat regions along said insertion portion, said regions of said first and second faces along said insertion portion lying in generally parallel planes;

said handle having a butt portion being located adjacent said second end, said butt portion being adapted for positioning in the palm of a user, said butt portion having a generally circular cross section transverse said longitudinal axis, said butt portion having a maximum thickness defined between said first and second faces;

said handle having a middle portion interposed between said insertion portion and said butt portion, said middle portion being adapted for positioning the fingers and thumb of the user;

said middle portion having a generally rectangular cross section taken transverse said longitudinal axis, and a thickness defined between said first and second faces, said first and second faces having generally flat regions along said middle portion, said generally flat regions of said first and second faces along said middle portion lying in generally parallel planes;

said planes of said generally flat regions of said first and second faces along said middle portion being generally parallel to said planes of said generally flat regions of said first and second faces along said insertion portion;

said middle portion having a thickness defined between said first and second faces, said thickness of said middle portion being greater than said thickness of said insertion portion and less than said maximum thickness of said butt portion;

wherein said maximum thickness of said butt portion is at least about twice said thickness of said middle portion;

said first and second faces each having a shoulder formed between said middle portion and said insertion portion, said shoulders being adapted for abutting against the ferrule;

said first and second faces along said middle portion each having an arcuate region adjacent said butt portion such that said first and second faces curve between said middle portion and butt portion;

said insertion, butt and middle portions each having a length defined in a direction extending between said first and second ends;

wherein said length of said middle portion is about equal to said butt portion;

said middle portion having a bore therethrough extending between said first and second faces, said bore being generally cylindrical, said bore being positioned on said middle portion towards said butt portion, said bore having a center axis located at a midpoint between said first and second sides; and an outer coating being provided on said butt portion and said middle portion, said outer coating substantially covering said butt portion and said middle portion, said outer coating comprising a resiliently compressible material for aiding the grip of the user.

* * * * *